United States Patent [19]

Paquette

[11] Patent Number: 4,589,153

[45] Date of Patent: May 20, 1986

[54] AIRCRAFT SPARK PLUG GAPPING TOOL

[76] Inventor: Edward J. Paquette, 2058 S. Mountain Ave., Ontario, Calif. 91761

[21] Appl. No.: 597,072

[22] Filed: Apr. 5, 1984

[51] Int. Cl.[4] ..... B25F 1/00

[52] U.S. Cl. ..... 7/169; 7/100; 81/484; 72/458

[58] Field of Search ..... 81/3 R; 7/100, 169; 72/458, 308

[56] References Cited

U.S. PATENT DOCUMENTS

| | | | |
|---|---|---|---|
| 1,458,690 | 6/1923 | Elwell | 7/100 |
| 1,616,653 | 2/1927 | Frasier et al. | 72/458 |
| 1,736,585 | 11/1929 | Fehlhaber | 72/458 |
| 1,812,496 | 6/1931 | Rabezzana | 72/458 |
| 1,820,364 | 8/1931 | Pringle | 7/100 |
| 2,581,439 | 1/1952 | Pentland | 72/458 |
| 2,688,134 | 9/1954 | Kane et al. . | |
| 3,122,034 | 2/1964 | McKenzie . | |
| 3,965,776 | 6/1976 | Wolstenholme et al. | 81/3 R |
| 4,061,058 | 12/1977 | Douglas | 7/100 |

FOREIGN PATENT DOCUMENTS

| | | | |
|---|---|---|---|
| 526219 | 9/1940 | United Kingdom | 72/458 |

*Primary Examiner*—Roscoe V. Parker
*Attorney, Agent, or Firm*—Leo R. Carroll

[57] ABSTRACT

A combination spark plug gapping tool which has the capability of opening or closing the spark plug gap on a variety of aircraft, industrial, or automotive spark plugs. The single tool may be used with side electrode designs containing up to three electrodes, including both stud and wire electrode types. Also included is a sight gauge hole for visual checks of the center electrode, and a pointed end for scraping carbon. One end of the tool contains an offset two-pronged slotted fork which is sized to reach around the center electrode to open the gap by raising two side electrodes at a time. When turned over, the two offset prongs reach around the electrode being set and bear against the inner plug wall, thereby permitting gap closure by pushing. A center slot on the edge of the tool is used to adjust side wire electrodes.

11 Claims, 6 Drawing Figures

AIRCRAFT SPARK PLUG GAPPING TOOL

BACKGROUND OF THE INVENTION

1. Techinical Field

This invention relates generally to apparatus for adjustment of spark plug electrode gaps and more particularly to combination tools arranged to set the gap on aviation or industrial spark plugs.

Spark plug removal for cleaning or replacement in aircraft engines is a mandatory operation during routine maintenance or required overhaul. It is quite common to find that regapping is required after cleaning or for initial setting of a new plug. Such gaps may be either large or small, necessitating a tool for both quick opening or closure of said gap.

2. Background Art

Development of spark plug gapping tools has usually been directed toward either plier or lever type instruments. This latter type has long been utilized in bending electrode on automotive spark plugs, with side edge slotted designs being most prevalent. In use, an "L" shaped stud or wire electrode is bent by levering about its own attachment point. A variation of this approach, in which levering is against either the other electrodes or against the plug body itself is best illustrated by Rabezzana in U.S. Pat. No. 1,812,496. Here, a cam-like, "C" shpaed open end wrench is rotated in the annular region about the center electrode. Closure is effected by bending the side electrode against the center electrode, and opening is caused by levering the side electrode against the plug housing. In the field of aircarft spark plugs however, side annular spaced electrodes are also frequently used. Two or three stud electrodes are equally spaced about a center electrode. Care must be taken to bend these side electrodes without overstress, and it is not desirable to touch and possibly scratch the center electrode.

A plier type tool can be used to close a gap by bending one side electrode against another, but a problem exists in obtaining equal spacing. Special pliers for aircraft spark plug gap opening are illustrated by Pentland, in U.S. Pat. No. 2,581,439. A tool is therein described which grips the side electrode and opens the gap by fulcruming the pliers against the electrode shell. Its use, however, in gap closure is more dangerous relative to the ability to touch the center electrode, and such use is not recommended.

Although wire type plugs are more amenable to single slot type gap closures, the mechanic is forced to carry on array of special instruments. A need exists therefore for a single combined instrument which is adapted for use across the variety of aircraft spark plugs encountered by the aviation mechanic.

SUMMARY OF THE INVENTION

This invention features a simple singlelever type gapping tool which is especially useful in setting the gap on a variety of aircraft spark plugs. It operates on stud electrodes by fulcruming the side electrode against the inner wall of the plug body. The tool utilizes in combination, an offset slotted fork end, a curved pointed end, a mid-point slot for wire electrodes and a viewing hole for sight gauging of the diameter and ellipticity of the center electrode.

The inner surfaces of the forked end bear on the outer side surface of the electrode, while the prong tips fulcrum against the inner body when closing the gap. This bending action leaves the gap free for viewing, thereby reducing the probability of stressing the electrode more than is necessary.

The offset angle, fork tong length and fork inner diameter are chosen so that the same tool end may be utilized for gap opening by simply turning the tool over. This novel approach permits the tool to "reach around" the center electrode and lever two electrodes of a three electrode plug upward from the bottom side of the studs. The fulcrum point in this case is the flat bottom surface of the plug body. The fork outside diameter is selected to permit a similar levering upward on a two electrode plug.

For the relatively few cases where an electrode is not level about a plug radius line, an offset pointed end is provided. This "ski tip" can be used to lever the side edge of an electrode one at a time for leveling. The pointed end also has benefit as a scraping tool for removing carbon deposits on a used plug as part of a preliminary inspection.

An additional feature, useful during preliminary inspection, consists of one or more holes of the normal diameter of a new center electrode. A quick visual viewing of the electrode through the hole will quickly inform the operator whether or not the electrode is sufficiently worn or out-of-round so as to preclude refurbishing.

It is a prime object of this invention to provide a single spark plug gapping tool which may be used to open or close the electrode gaps on both two and three side electrode spark plugs.

It is a further object of this invention to provide a combination tool which may also be utilized to set the spark plug gap on side wire spark plugs.

It is a further object of this invention to provide a combination tool which may also be utilized to scrape carbon from the inner sides of a spark plug.

It is a further object of this invention to provide a combination tool which may be used to sight gauge the diameter of the center electrode of a spark plug.

It is a further object of this invention to provide a simple, low cost tool which will perform the current function of several separate tools.

Further objects and advantages of the invention will appear from the following description taken together with the accompanying drawings.

DESCRIPTION OF THE PREFERRED EMBODIMENT

Figure 4:
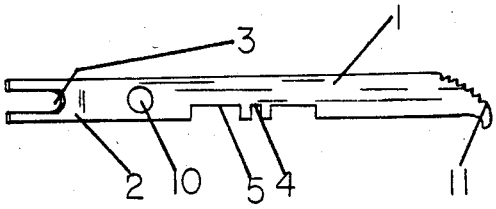
FIG. 4 is a side elevation view of my spark plug gapping tool.

With reference to the side elevation view of FIG. 4, my invention includes an elongated handle body 1, having two opposite ends. One end of the handle body contains a two pronged fork 3 bent outward at an offset angle with respect to the longitudinal axis of the handle body, said bend being towards the viewer about line 2. The opposite end of device 1 is shaped with a pointed tip 11, bent in ski-tip fashion in the direction away from the viewer opposite to end 3.

Figure 1:
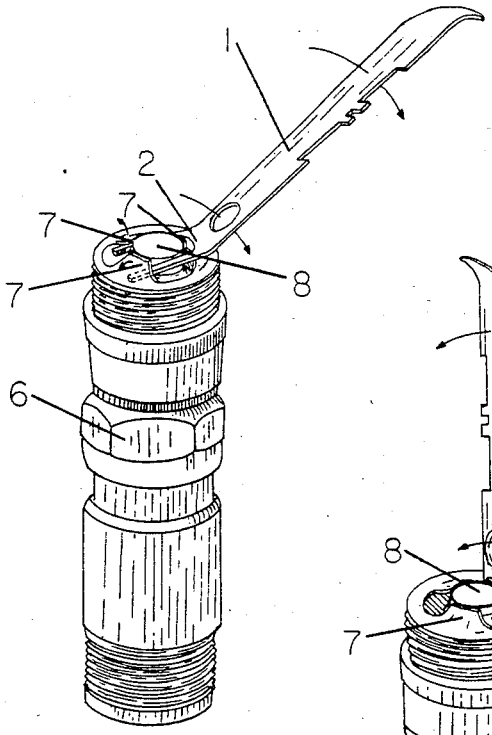
FIG. 1 is an isometric view of my invention in operational opening-gap engagement with a three-electrode spark plug work piece.

FIG. 1 presents the gapping tool 1 engaged with a spark plug work piece 6. This plug is of the three electrode variety, with three side attached stud electrodes 7, disposed at equal 120 degree points about a center electrode 8. The engagement of FIG. 1 is that of bending the electrodes upward and outward about an axis line in the bottom plane of the plug. The forked end 3, of tool 1, has a sufficient center opening between the tongs so as to permit it to reach around both the external diameter of the round center electrode 8 and one of the electrodes 7 and to engage the bottom surface of each of the other two electrodes 7 with the tips of the fork 3. The bend line 2 bears against the bottom side wall edge surface of the plug 6 and when the tool is rotated in the clockwise direction shown in FIG. 1, the spark plug gap between side electrodes 7 and center electrode 8 is increased.

Figure 2:
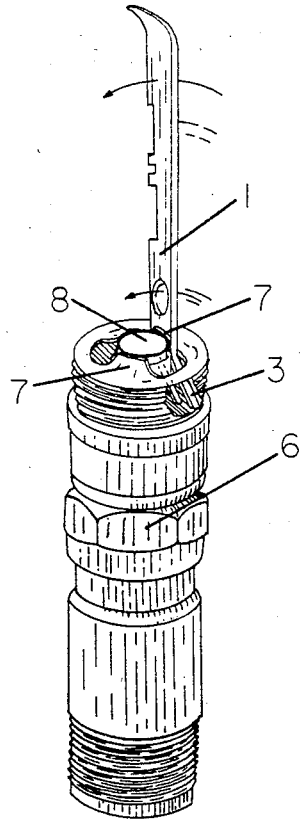
FIG. 2 is an isometric view of my invention in operational closing-gap engagement with the work piece of FIG. 1.

Referring to FIG. 2, the tool is depicted in gap closing engagement on the same three electrode plug shown in FIG. 1. The bend angle of the tool at point 2, has been chosen such that the engagement indicated in FIG. 2 is achieved by simply turning the tool 1 over about its longitudinal axis. When so placed, the inner edge of the fork opening at 3 engages the outside tip surface of one of the other three electrodes 7. The outer end of each forked tong straddles the electrode attachment to the plug shell and the fork tips bear against the inner side wall of the spark plug electrode cavity at the electrode end of plug 6. When rotated counterclockwise, as shown in FIG. 2, an electrode 7 is bent inward towards center electrode 8 and the gap is closed. When so used, the tool does not obstruct viewing of the gap and a conventional gauge may be inserted in the gap for measurement.

Figure 3:
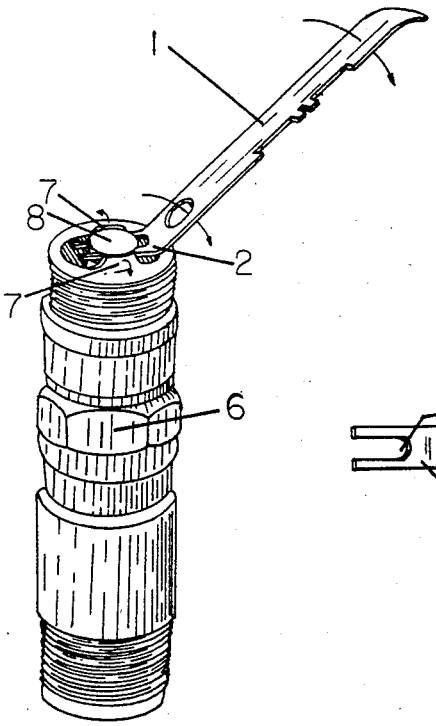
FIG. 3 is an isometric view of my invention in opening-gap engagement with a two-electrode spark plug work piece.

FIG. 3 indicates use of tool 1 in opening the gap on a two electrode spark plug. Placement of tool 1 relative to plug 6 is similar to that of FIG. 1. The engagement, however, is between the outer edges of the forked tong 3 and both side electrodes 7. Clockwise rotation, again, will open the gap.

Figure 5:
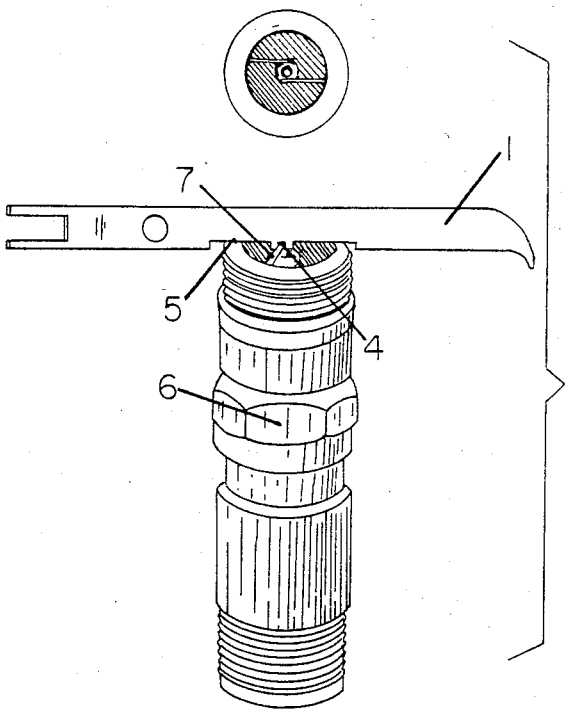
FIG. 5 is an isometric view of my invention in operational engagement with a side-wire spark plug work piece.
Figure 6:
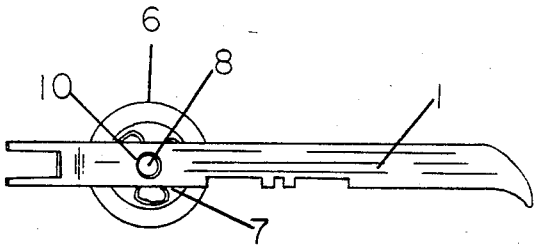
FIG. 6 is a plan view of my invention in alignment with the end of a spark plug work piece such that the center electrode of the work piece may be seen through the viewing hole.

FIG. 5 shows the tool 1 being used with a side wire variety of spark plug 6. This type of plug includes a pair of narrow wire type electrodes disposed almost perpendicularly to the inner shell wall of plug 6 and having a leg such that a gap is formed with a center post electrode. Gapping tool 1 is fitted with an side edge slot 4 which has an opening sufficient to engage wire 7 in FIG. 5. Recessed areas 5 are placed in tool 1 to permit tool 1 to clear and rest upon the bottom flat surface of plug 1. Adjustment of the gap is either an open or closed direction is accomplished by rotation of tool 1 in a horizontal plane about the vertical axis of plug 6.

For convenience of the operator, gapping tool 1 is also provided with sight hole 8. This hole is precision drilled at the diameter of a new center electrode 8. Center electrodes are subject to wear in which their diameter reduces and sometimes becomes elliptic in shape. This will in turn result in uneven arcing and uncertain gauge measurements when gapping. When tool 1 is placed over the bottom of plug 6, so that gauge hole 10 is aligned with center electrode 8, excessive diameter reduction and ellipticity may be easily noted.

The final feature of tool 1 consists of pointed tip 11 shown in FIG. 4. This end may be utilized for picking or scraping carbon deposits attached to the electrode ends of the spark plugs. Although shown as a pointed end bent in ski tip fashion, to reach inside of the plug's bottom electrode cavity opening, it can, of course, be adapted to include sharper points or serrated edge features. Provision of the scraping end 11 is in keeping with my object of providing one composite tool useful for the mechanic servicing several types of spark plugs.

It is to be understood that the foregoing description is merely illustrative of the preferred embodiment of the invention and that the scope of the invention is not to be limited thereto, but is to be determined by the scope of the appended claims.

What I claim is:

1. A tool for adjusting the gap between side and center electrodes situated within an electrode cavity at one end of a spark plug, comprising:

an elongated handle body having first and second opposite ends;

a fork tip connected to said first end of said handle consisting of two parallel prongs spaced apart so that the outside edges of each said prong will fit under the bottom surface of adjacent side electrodes and the inside edges define an aperature between said prongs sufficient to enclose the external diameter of said center electrode and to enclose the width of any said side electrode; and means of connecting said fork tip at an offset angle to the longitudinal axis of said handle so that said tool may be operated in a first position in which the spark plug gap may be increased by engagement of the bottom surface of two side electrodes with each said prong and levering said electrodes about a fulcrum point of contact between said handle and the bottom side wall edge of said spark plug, said tool being operable in a second position turned over with respect to said first position about said handle longitudinal axis so that the spark plug gap may be decreased by top staddling a side electrode and bending said electrode toward said center electrode by engagement of the inner edge of said fork opening with the outside tip surface of said electrode while levering against the engagement points of the tips of said forks and the inner side wall of said spark plug electrode cavity.

2. A tool for adjusting the gap between side and center electrodes situated within an electrode cavity at one end of a spark plug as recited in claim 1, further comprising:

means connected to said second handle end for scraping carbon deposits from the electrode cavity.

3. A tool for adjusting the gap between side and center electrodes situated within an electrode cavity at one end of a spark plug as recited in claim 1, further comprising:

means for adjusting the gap between a a side wire electrode and a center electrode.

4. A tool for adjusting the gap between side and center electrodes situated within an electrode cavity at one end of a spark plug as recited in claim 1, further comprising:

means for sight gauging the diameter of the center electrode of a spark plug.

5. A tool for adjusting the gap between side and center electrodes situtated within an electrode cavity at one end of a spark plug as recited in claim 1 wherein said connecting means consists of an integrally bent combined handle and fork.

6. A tool for adjusting the gap between side and center electrodes situated within an electrode cavity at one end of a spark plug as recited in claim 2 wherein said scraping means consists of a shaped point.

7. A tool for adjusting the gap between side and center electrodes situated within an electrode cavity at one end of a spark plug as recited in claim 2 wherein said scraping means consists of a serrated tooth edge.

8. A tool for adjusting the gap between side and center electrodes situated within an electrode cavity at one end of a spark plug as recited in claim 3 wherein said side wire adjusting means consists of a handle body having a side edge slot for engagement of the side wire electrode.

9. A tool for adjusting the gap between side and center electrodes situated within an electrode cavity at one end of a spark plug as recited in claim 4 wherein said sight gauging means consists of a handle body having a circular aperature contained therein.

10. A tool for adjusting the gap between side and center electrodes situated within an electrode cavity at one end of a spark plug as recited in claim 2 further comprising means for adjusting a side wire electrode.

11. A tool for adjusting the gap between side and center electrodes situated within an electrode cavity at one end of a spark plug as recited in claim 10 further comprising:

means for sight gauging the diameter of the center electrode of a spark plug.

* * * * *